US005224830A

United States Patent [19]

Wang

[11] Patent Number: 5,224,830

[45] Date of Patent: Jul. 6, 1993

[54] HOLOGRAPHICALLY-DECORATED CEILING FAN

[76] Inventor: Sui-Mu Wang, c/o Hung Hsing Patent Service Center, P.O. Box 55-1670, Taipei, Taiwan, 10477

[21] Appl. No.: 957,012

[22] Filed: Oct. 6, 1992

[51] Int. Cl.[5] ..... F04D 29/00

[52] U.S. Cl. ..... 416/5; 359/1; 359/522

[58] Field of Search ..... 416/5; 359/1, 522; 362/96

[56] References Cited

U.S. PATENT DOCUMENTS 5,028,206 7/1991 Kendregan et al. ..... 416/5
5,072,341 12/1991 Huang ..... 362/96
5,082,422 1/1992 Wang ..... 416/5

FOREIGN PATENT DOCUMENTS 301994 12/1989 Japan ..... 416/5
301995 12/1989 Japan ..... 416/5

*Primary Examiner*—Edward K. Look
*Assistant Examiner*—James A. Larson

[57] ABSTRACT

A ceiling fan includes a plurality of fan blades radially secured to a motor shaft of a driving motor of the fan, each fan blade fixed with a holographic recording plate thereon pre-recorded with holograms of many sets of interference patterns of colorful decorative features within the recording plate, whereby upon a rotation of the fan blades as driven by the driving motor as being illuminated by a plurality of lamps, the patterns of color features recorded in each holographic recording plate will be observed with diversified color changes of the decorative features and superimposed decorative feaures with respect to a rotating angle as rotated by each fan blade, thereby enriching an optical decorative effect with simpler production, easier operation and minor maintenance problems of the fan.

2 Claims, 2 Drawing Sheets

HOLOGRAPHICALLY-DECORATED CEILING FAN

BACKGROUND OF THE INVENTION

A conventional ceil fan such as U.S. Pat. No. 5,082,422 entitled "Illuminative Fan" issued to the same inventor of this application includes a plurality of illuminators selected from light-emitting diodes juxtapositionally interlacedly disposed on each fan blade capable of being flushed or colored so that upon a rotation of the fan, the illuminators will produce diversified optional or colorful figures on the rotating blades due to persistence of human vision either flashingly or continuously for enriching a decorative effect for the illuminative fan.

However, such an illuminative fan should be provided with a plurality of light-emitting diodes and a controller controlling the lighting of the illuminators, increasing a production complexity and operational and maintenance problems.

SUMMARY OF THE INVENTION

The object of the present invention is to provide a ceiling fan including a plurality of fan blades radially secured to a motor shaft of a driving motor of the fan, each fan blade fixed with a holographic recording plate thereon pre-recorded with holograms of many sets of interference patterns of colorful decorative features within the recording plate, whereby upon a rotation of the fan blades as driven by the driving motor as being illuminated by a plurality of lamps, the patterns of color features recorded in each holographic recording plate will be observed with diversified color changes of the decorative features and superimposed decorative feaures with respect to a rotating angle as rotated by each fan blade, thereby enriching a optical decorative effect with simpler production, easier operation and minor maintenance problems of the fan.

DETAILED DESCRIPTION

Figure 2:
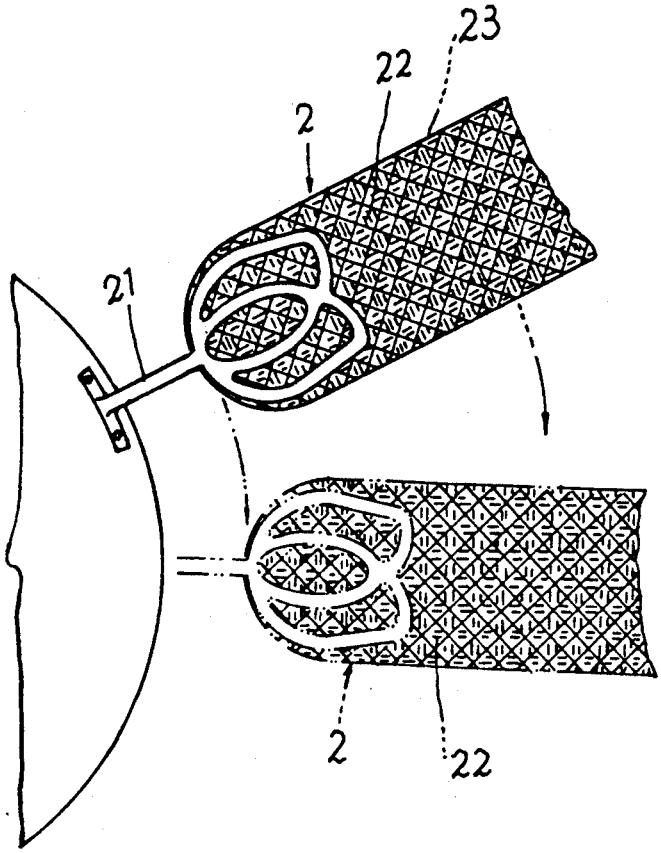
FIG. 2 is an illustration showing a color change of the patterns recorded in each fan blade.
Figure 1:
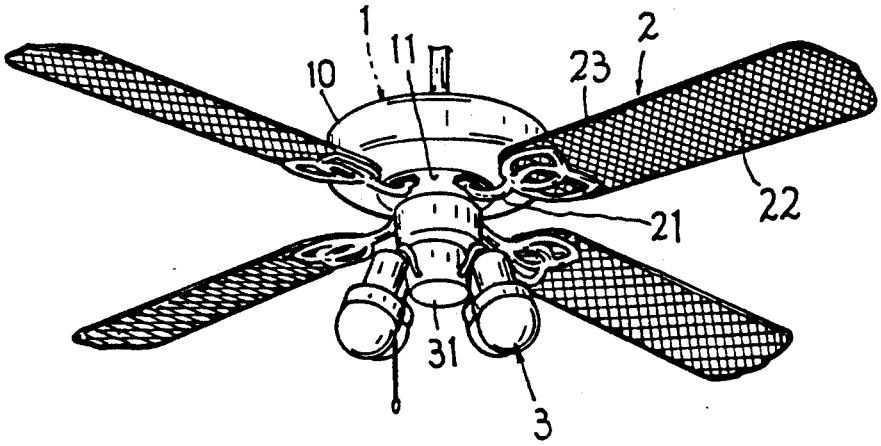
FIG. 1 is a perspective view of the present invention.
Figure 3:
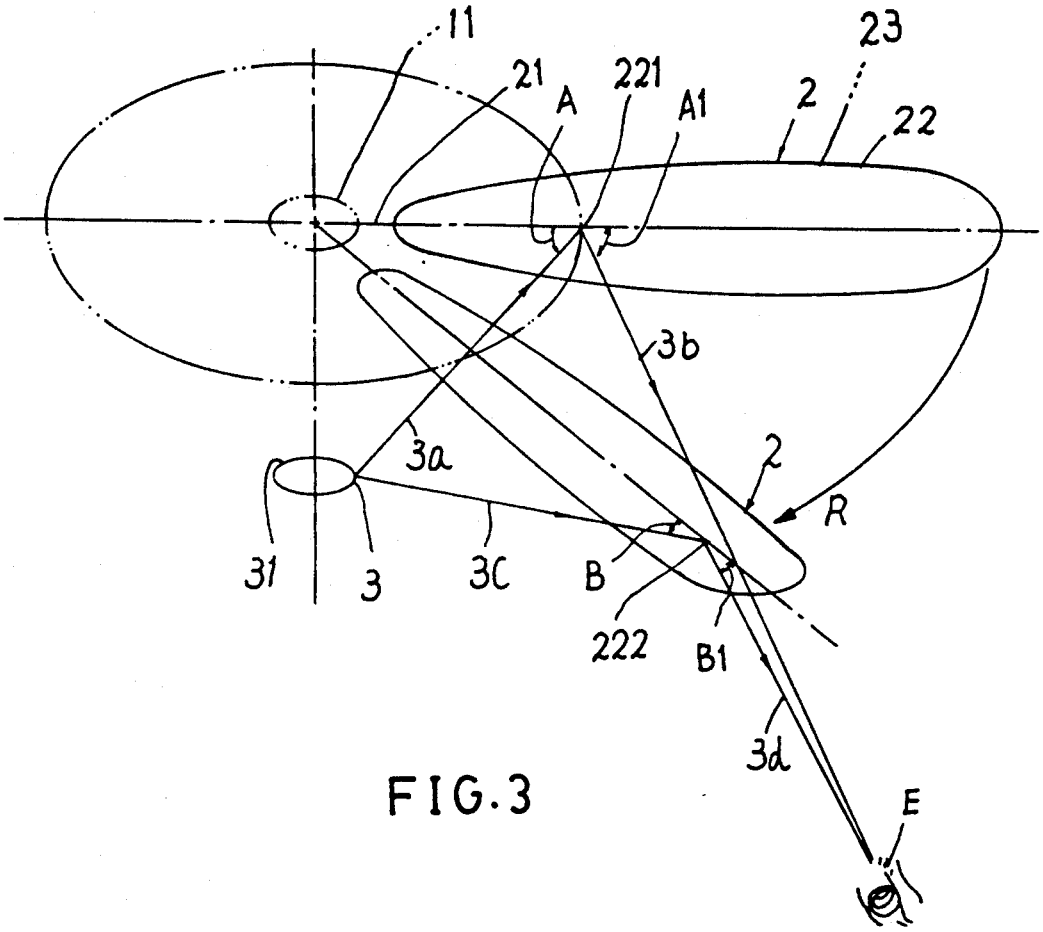
FIG. 3 shows an operational principle for changing the colors of the patterns in accordance with the present invention.

As shown in FIGS. 1–3, the present invention comprises: a driving motor 1 having a motor housing 10 secured to a ceiling of a building or a house, a central disk 11 secured on a motor shaft driven by the driving motor 1; a plurality of fan blades 2, each fan blade 2 having a fixing arm member 21 radially mounted on the central disk 11 of the motor 1, a holographic recording plate 22 fixed on a substrate plate 23 and secured with each fixing arm member 21; and a plurality of lamps 3, each lamp 3 secured to a lighting fixture 31 mounted to the motor housing 10 or directly mounted to the ceiling (not shown).

The holographic recording plate 22 secured on each fan blade 2 is pre-recorded with a plurality of holograms of interference patterns of colorful decorative features capable of producing superimposed decorative features and diversified color changes of the decorative features when the fan blade is operatively rotated to change each incident illuminating light beam projecting towards each fan blade 2 as illuminated by the lamp 3.

In preparing a holographic recording plate, a laser beam may be applied for making interference patterns of a hologram of a decorative feature. Plural superimposed interference patterns of the decorative feature may be formed in processing the holographical recording plate, which is a conventional art and will not be discussed in detail in this application.

In the present invention, the lamp 3 is provided to project its light beams directly or obliquely onto the recording plate 22 on each fan blade 2 and the incident light beam such as 3*a*, 3*c* as shown in FIG. 3 is then reflected downwardly to an observer's eye E. The fan blade 2 may also be made as a transparent plate and embedded with holographic film (not shown) in the transparent blade, whereby the light may be projected to transmit through the thickness of the fan blade 2.

Therefore, the lamp installation, light projecting orientations whether direct transmission, or reflection, or deflection, and the lamp styles, locations or arrangements are not limited in this invention.

In processing a hologram with thick media, the recorded interference patterns are surfaces embedded with the recording material of the recording plate 22. Diffraction from the thick holograms, which are 3-dimensional structures is orientation sensitive. A diffracted wave occures only when the light impinges at the proper incidence angle. Consequently, many sets of wave patterns can be recorded in a single volume hologram, each with the recording material having a slightly different orientation. When the hologram is illuminated, only one set of fringes at a time can have the proper orientation to produce a diffracted wave. When the plate is rotated slightly the diffracted wave is extinguished, and another diffracted wave, produced by another fringe set appears.

The specific diffracted wave will indicate a specific color. Therefore, the interference patterns of colorful decorative features can be observed from each rotating angle about an axis of the driving motor shaft with a specific color with respect to its specific diffracted wave. This is the operating principles of this application revealing varied color changes of the decorative features pre-recorded in the plate 22.

As shown in FIG. 3, a first incident light beam 3*a* illuminated by the lamp 3 is reflected on the recording plate 22 of the fan blade at an incident angle A and a reflective angle A1, the reflected light 3*b* is then projected towards the observer's eye E. When the fan blade 2 is rotated in direction R to the position whereby the incident angle B as projected by the incident light beam 3*c*, a reflective light 3*d* reflected from the blade 2 at the reflective angle B1 is projected towards the observer's eye E. Since angle A or A1 is different from angle B or B1, the different angles of incident light beams towards the holograms recorded in the recording plate 22 of the fan blade 2 will therefore incur different diffracted waves of different colors, thereby causing a variation of colors during the rotation of the fan blades 2 and enriching the optical decorative effect of this invention, to be superior to any conventional ceiling fans without vivid color changes.

The decorative features, figures, designs, and arrangements can be modified by those skilled in the art without departing from the spirit and scope as claimed in this invention.

The lamp 3 may also be installed on another lighting fixture (not shown), not directly mounted on the motor housing 10.

I claim:

1. A ceiling fan comprising:

a driving motor having a motor housing secured to a ceiling of a building, a central disk secured on a motor shaft driven by the driving motor; an plurality of fan blades, each said fan blade having a fixing arm member radially mounted on the central disk of the motor, a holographic recording plate fixed on a substrate plate and secured with each said fixing arm member; and a plurality of lamps, each said lamp secured to a lighting fixture mounted to the motor housing; and each said holographic recording plate pre-recorded with a plurality of holograms of interference patterns of colorful decorative features capable of producing superimposed decorative features and diversified color changes of the decorative features when each said fan blade is operatively rotated to change each incident illuminating light beam projecting towards said fan blade as illuminated by each said lamp.

2. A ceiling fan comprising:

a plurality of fan blades rotatably driven by a driving motor secured to a building ceiling;

each said fan blade secured with a holographic recording plate thereon, said recording plate prerecorded with a plurality of holograms of colorful decorative features capable of producing color changes during a rotation of the fan blades, whereby upon an illumination on said recording plate of said fan blade, a plurality of decorative features with color changes will be revealed on each said recording plate of each said fan blade when each said fan blade is continuously rotated about an axis of said driving motor.

* * * * *